United States Patent [19]

Brohard et al.

[11] 4,212,101

[45] Jul. 15, 1980

[54] METHOD FOR ADJUSTING PIEZOELECTRIC RELAY OPERATING GAPS

[75] Inventors: Ivan E. Brohard, Westerville; James R. Freeburg, Reynoldsburg, both of Ohio

[73] Assignee: Bell Telephone Laboratories, Incorporated, Murray Hill, N.J.

[21] Appl. No.: 973,537

[22] Filed: Dec. 26, 1978

[51] Int. Cl.[2] ..... H01H 11/00

[52] U.S. Cl. ..... 29/622; 337/94; 337/368

[58] Field of Search ..... 29/622; 337/360, 368, 337/349, 82, 94, 83

[56] References Cited

U.S. PATENT DOCUMENTS

| | | | |
|---|---|---|---|
| 2,412,142 | 12/1946 | Getchell | 337/368 |
| 2,951,136 | 8/1960 | Wells | 337/94 |
| 3,361,883 | 1/1968 | Brassard | 29/622 |
| 3,673,535 | 6/1972 | Rosenberg | 29/622 |
| 4,047,141 | 9/1977 | Holden | 337/89 |

*Primary Examiner*—Francis S. Husar

*Assistant Examiner*—Gene P. Crosby

*Attorney, Agent, or Firm*—William H. Kamstra

[57] ABSTRACT

A method for adjusting the operating gap between the actuator beam (11, 12) and the moveable contact spring (13, 14) of a piezoelectric relay to achieve a gap (gf) of a width to achieve optimum relay reliability. A fixed contact (24) upon which the contact (35) of the spring (13) rests, is mounted on a bracket (25) in turn mounted on the relay substrate (15) by a solder layer (30). The relay actuator beam (11), normally adapted to raise the spring (13) to separate the contacts, is separated from the spring (13) by an initial gap (g) and is energized by an adjust voltage (Va) of a magnitude to exert a force just equal to the spring force. The solder layer (30) is then heated to the melting point to permit the spring (13) to force bracket (25) downward and itself into contact with the beam (11). When the forces exerted by the beam (11), the fixed contact, and the spring (13) reach equilibrium, the solder layer (30) is allowed to set and the adjust voltage (Va) is removed. The beam (11) restores, leaving the desired gap (gf) between itself and the spring (13).

3 Claims, 7 Drawing Figures

METHOD FOR ADJUSTING PIEZOELECTRIC RELAY OPERATING GAPS

TECHNICAL FIELD

This invention relates to piezoelectric relay arrangements and, more particularly, to methods for the fabrication of such relay arrangements.

BACKGROUND OF THE INVENTION

Piezoelectric relays have in recent years shown promise as alternatives for relays operated electromagnetically. In addition to not requiring windings and cores, such relays offer a number of other advantages among which may be mentioned their low power consumption and heat generation, reduced physical size, relatively simple component parts, and, importantly, their potential for batch fabrication by printed wiring techniques. Further, the voltages required for their operation are sufficiently low to permit integrated circuit control.

Typically, the switch element of a relay operated by piezoelectric or electrostrictive effect comprises a laminate formed of two layers of piezoelectric ceramic material each having an electrode electroplated to each side. The two coated sheets are cemented to opposite sides of a separating conductive centervane, which centervane, in one mode of operation, also constitutes one electrode of the relay. In a well-known fabrication step, the piezoelectric material of each layer has a remanent polarization induced therein by applied direct current electric fields. For the parallel mode of operation contemplated, the layers are polarized in the same direction. In one prior art arrangement, the piezoelectric laminate is mounted at one end on a base member and spaced therefrom by a spacer block. A bracket also mounted on the base member at its other end carries a contact spaced apart from and in alignment with a contact carried at the free end of the laminate. Flexure of the laminate to close the contacts is accomplished in the parallel mode by connecting and grounding the outer electrode coatings of the two layers and applying an operating voltage to the centervane. As a result, electrostatic fields are created in the layers which in one layer agree with the direction of polarization and in the other layer oppose that direction. In accordance with piezoelectric phenomena of ceramic materials, one layer expands lengthwise while the other layer contracts. The resulting stresses cause the laminate to bend; for the cantilever laminate here envisioned, the bending motion is perpendicular to the planes of the laminate electrode coatings thereby causing the contacts to close. Removal of the operating voltage restores the contacts as a result of the restoring mechanical effect.

Although piezoelectric relays have proved themselves in many applications, their fabrication has been attended by a number of problems. Thus, for example, the forces and deflections attainable by piezoelectric effect are relatively small and not uniformly precisely predictable. As a result, the laminate actuator beam (or bimorph as it is frequently termed) must be very accurately positioned relative to the electrical contacts which it controls. This positioning and location of relay parts has in the past been accomplished by the expensive and time-consuming expedient of carefully controlling the dimensions and tolerances of the various relay elements. Even when a maximum adherence to close tolerances is achieved, the difficulty of realizing a piezoelectric laminate of flat, uniform surface contours leaves the problem of inconsistent actuator response from relay to relay upon the application of the same operating voltages. As a result, if the operating gap between the actuator beam and the relay contact spring is maintained of uniform width during fabrication, the control of the spring by the actuator beam may vary from relay to relay and thus affect relay reliability. This invention is thus chiefly directed to the problem of providing a simple and inexpensive method for individually adjusting the operating gap between a contact spring and the actuator beam of a piezoelectric relay without concern for inconsistencies in the mechanical forces generated by the actuator beam.

SUMMARY OF THE INVENTION

The gap adjustingg method according to this invention, although broadly applicable, may be practiced in connection with a piezoelectric relay arrangement in which the bimorph actuator beam controls the continuity of an electrical circuit path including a moveable contact spring, and a contact supported by a fixed bracket. In one break contact mode of operation, for example, the actuator beam is positioned beneath the contact spring and is flexed to raise the contact carried by the latter from its normal position resting on the fixed contact. According to the principles of this invention, the fixed contact bracket is mounted on the relay substrate by means of a solder layer or preform. The preform solder layer is selected to melt at a temperature somewhat below the melting point of the solder employed elsewhere in the relay assembly. The tension of the moveable contact spring is adjusted so that, after assembly of the relay, it bears down on the fixed contact with a predetermined force. This force is supported by the solder preform layer which is also dimensioned to support the contact spring out of engagement with the actuator beam end to present an initial gap between the members. Advantageously, and in accordance with an objective of this invention to relax fabrication tolerances, the initial gap width is not critical at this point in the relay assembly. The width to which the operating gap is ultimately to be adjusted has been empirically established in practice to ensure maximum relay reliability and is equal to the flexure of the beam caused by the application of an adjust voltage of a predetermined magnitude thereto minus the degree of flexure of the actuator beam required to exert a force substantially equal to the opposing force exerted by the contact spring. The adjust voltage is experimentally determined as equal to the voltage required to flex the beam a distance approximately equal to the ultimate gap desired plus the voltage sufficient to produce a beam force equal to the downward force exerted by the contact spring. The latter approximate gap may now be precisely adjusted for an individual relay being assembled in accordance with this invention as follows:

In a first step in the gap adjusting method, the adjust voltage is applied to the actuator beam in the conventional manner, the magnitude of the voltage being determined as sufficient to cause the aforementioned actuator beam deflection. The solder layer is now heated to the melting point thereby allowing the moveable contact spring to urge the fixed contact and its supporting bracket downward toward the relay substrate. The contact spring now also closes on the flexed actuator beam and exerts a force on the latter member. The forces exerted on the fixed contact and the actuator beam by the contact spring continue until the reactive forces of the former members equal the force exerted by the contact spring. When the movement of the members has reached equilibrium, the solder layer heat is removed thereby permitting the latter solder to solidify and hold the fixed contact bracket in place. As the adjust voltage is removed from the actuator beam, it restores to its normal, unflexed position leaving the desired operating gap which has now been precisely determined for the particular relay under assembly.

BRIEF DESCRIPTION OF THE DRAWING

The advantages together with the practice of a piezoelectric relay operating gap adjusting method of this invention will be better understood from a consideration of the detailed description of illustrative steps thereof which follows when taken in conjunction with the accompanying drawing in which.

DETAILED DESCRIPTION

Figure 1:
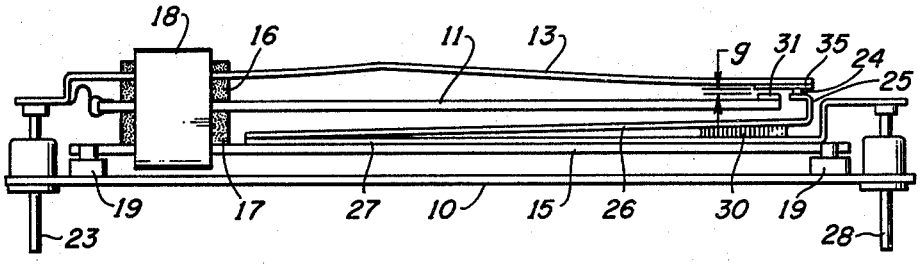
FIG. 1 is a side view of one illustrative piezoelectric relay assembly in connection with which the method of this invention may advantageously be practiced.
Figure 2:
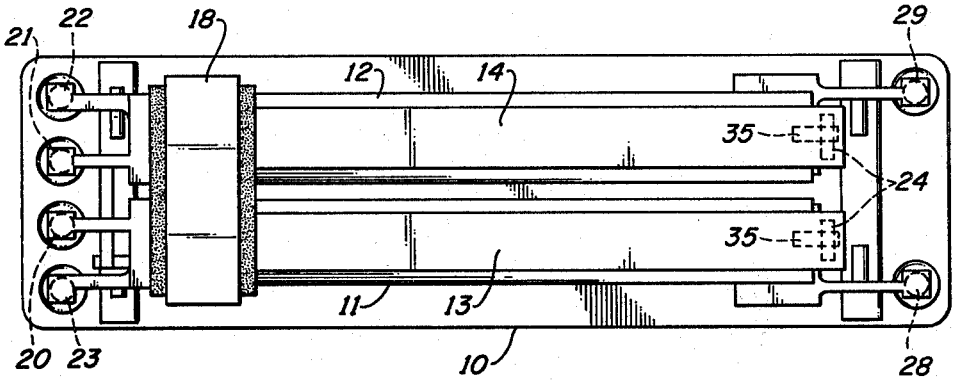
FIG. 2 is a top plan view of the relay assembly FIG. 1.

An exemplary piezoelectric relay arrangement with which the gap adjusting method of this invention may advantageously be practiced during its fabrication is shown in FIGS. 1 and 2 and, in one mode of operation, accomplishes by means of individual break contacts the simultaneous interruption of two circuit paths. As will appear hereinafter, the relay is simply modified to control the completion of a single circuit path in a make mode of operation. The relay elements are mounted on a base 10 which may in practice comprise a part of an enclosing envelope. A pair of piezoelectric bimorph actuator beams 11 and 12 are maintained in a spaced-apart relationship with a pair of moveable contact springs 13 and 14 and substrate 15 by means of spacer blocks 16 and 17. A clamp means 18 maintains the stacked members firmly in their positions on substrate 15, which substrate in turn is mounted on base 10 by standoffs 19. Contact springs 13 and 14 are individually electrically connected at one end to relay terminals 20 and 21, respectively, extending from the underside of one end of the relay assembly.

Actuator beams 11 and 12 each conventionally comprises a centervane separating two layers of suitable piezoelectric material on the outer surface of each of which is affixed an electrode layer of electrically conductive material. The centervanes of each actuator beam 11 and 12 are electrically connected together and to a terminal 22 and the electrodes of both sides of each actuator beam are electrically connected together and to a terminal 23 of the relay assembly. At their other ends, contact springs 13 and 14 are typically provided with contacts 35 which, in the relay construction being described, rest on corresponding fixed contacts 24 mounted on brackets 25 formed at the ends of a pair of springs 26 extending rearward, one spring 26 being shown in FIG. 1. At their ends, springs 26 are connected to a second pair of springs 27 lying along and affixed to the surface of substrate 15, which springs 27 extend toward the fixed contact ends of springs 26 and are electrically connected to respective terminals 28 and 29 of the relay. This spring arrangement makes possible a vertical movement of the fixed contacts and their mounting brackets 27 without risk of a misalignment of the parts during the gap adjusting operation to be described hereinafter. Springs 26 are fixedly separated from springs 27 at the contact ends by solder layers 30, only one of which is visible in the drawing. The piezoelectric layers of actuator beams 11 and 12 are suitably poled prior to assembly in a well-known manner so that an operate voltage of predetermined magnitude and polarity flexes the beams 11 and 12 upwardly as viewed in the drawing to raise contacts 35 of springs 13 and 14, respectively, from engagement with the fixed contacts 24 beneath. In order to electrically isolate springs 13 and 14 from the electrode outer layers of actuator beams 11 and 12, the latter are provided at their contact surface ends with insulators 31. The thickness of solder layers 30 is determined so that an initial gap g is presented between the beam insulator surfaces and the mating surfaces of contacts 35. Importantly, the width of gap g is not critical at this point; accordingly, strict adherence to positional and dimensional tolerances of the members thus far described is not necessary.

Figure 3:
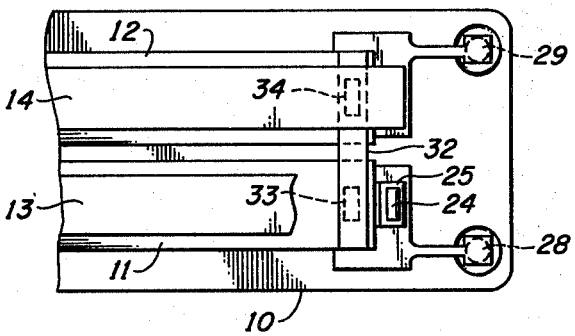
FIG. 3 depicts a portion of the assembly view of FIG. 2 showing the manner in which the relay assembly may be modified to achieve an alternate mode of operation.

In the foregoing, a relay assembly was generally described which is operable in a break mode to control the interruption of a pair of normally closed circuit paths extending between terminals 20 and 28 and between terminals 21 and 29. The relay assembly of FIGS. 1 and 2 is simply modifiable as shown in FIG. 3 to operate in a make mode to control the completion of a single circuit path. This is accomplished by affixing an electrically conductive strap 32 across the end insulators of actuator beams 11 and 12, strap 32 having mounted thereon a pair of contacts 33 and 34 positioned to mate with contacts 35 as beams 11 and 12 are flexed upward. As the latter contact is made, springs 13 and 14 are electrically connected together to close a circuit path between relay terminals 20 and 21. Actually, a make-before-break operation is thus incidentally performed since the two circuit paths earlier traced are at the same time interrupted. The relay organizations thus described are conventionally operated by the application of an operate voltage of suitable magnitude and polarity to the centervane terminals 22, electrode terminal 23 being conventionally connected to ground potential. Other details of the relay assemblies generally described in the foregoing as well as the manner of making the specific electrical connections referred to will be apparent to one skilled in the art, the details provided being sufficient for a complete understanding of the contact adjusting method of this invention which may now be considered.

The width of the gap, initially gap g, between springs 13 and 14 and actuator beams 11 and 12 ultimately to be achieved is determined, as mentioned hereinbefore, by the degree of flexure of actuator beams 11 and 12 required to just cause a movement of the latter beams toward and into contact with springs 13 and 14 and there exert a force just equal to the downward force exerted by the latter springs. The voltage Va required to achieve this flexure will be of a magnitude less than that of the full operate voltage ultimately to be employed in the operation of the relay after installation. Thus, preliminary to the practice of the contact adjusting method of this invention voltage Va is empirically determined in view of the known force exerted by a spring 13 or 14 in connection with a minimum, worst case flexure caused in a batch of bimorph beam elements before assembly of the relay. The steps of the method for achieving the desired ultimate contact gap may now be considered with particular reference to FIG. 4 where the steps are successively depicted in connection with the single circuit path elements of the relay assembly described in the foregoing, which elements are there shown in simplified, partially schematic form.

Figure 4A:
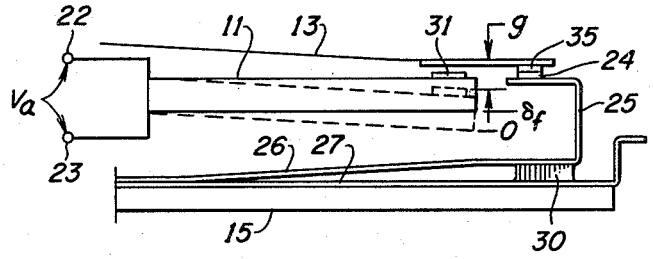
FIGS. 4*a* through 4*d* depict, in connection with simplified structure, the successive steps in the practice of the gap adjusting method according to the principles of this invention.
Figure 4B:
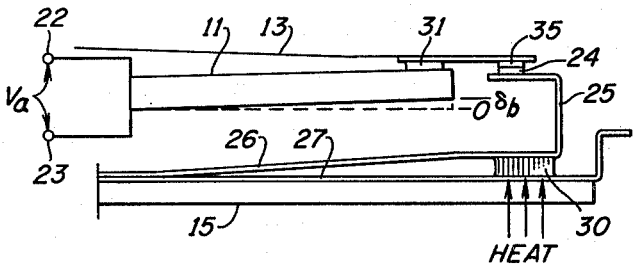
Figure 4C:
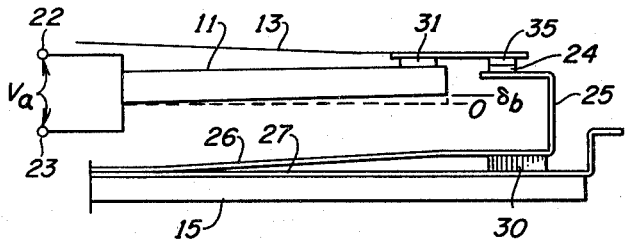
Figure 4D:
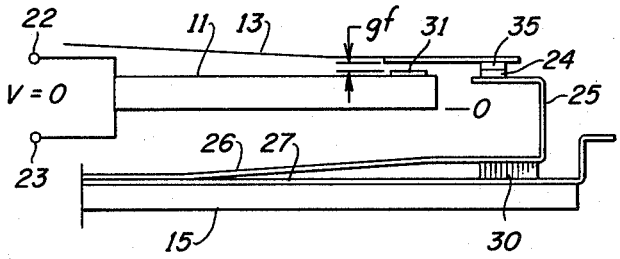

As shown in FIG. 4*a* in dashed outline, actuator beam 11 is initially at rest at a point 0 and out of contact with spring 13 to present an initial gap g referred to in the foregoing. (Shown enlarged in FIG. 4*a*.) Adjust voltage Va is now applied across terminals 22 and 23, that is, across the centervane of beam 11 and its grounded outer electrodes. The polarity of voltage Va is determined in accordance with the poling of the piezoelectric layers of actuator beam 11 and the direction of the flexure desired, that is, toward spring 13. Applied voltage Va causes a free deflection $\delta f$ of beam 11 from its rest position which falls short of contact with spring 13. With the continued application of voltage Va, heat is now applied to the solder layer 30 to its melting point. It may be noted at this point that solder layer 30 is selected to have a lower melting point than other solder which may be employed in the assembly of the relay to prevent disruption of the assembled parts. The melting of layer 30 and its continued heating permits the force of spring 13 to urge bracket 25 downward, contact 35 finally moving into contact with the end insulator 31 of actuator beam 11 as shown in FIG. 4*b*. Deflection of beam 11 is now reduced to a deflection $\delta b$ by the force of spring 13. The downward movement of spring 13 and that of bracket 25 continues until the combined reactive forces exerted by springs 26 and 27 (as an assembly) and beam 11 equal the force exerted by spring 13. When this system has come to equilibrium, the heat applied to layer 30 is removed and that element is permitted to solidify as demonstrated in FIG. 4*c* while the application of voltage Va is continued. During the foregoing operation, the elements have been held in alignment by springs 26 and 27. Finally, as demonstrated in FIG. 4*d*, when solder layer 30 has cooled, voltage Va is removed from terminals 22 and 23. As a result, actuator beam 11 restores to its normal zero deflection point leaving a final gap gf of the desired width.

As mentioned in the foregoing, the width of gap gf as thus adjusted was experimentally determined as an optimum minimum gap width to ensure reliable contact operation. Although in the foregoing the adjusting method of this invention was described in connection with a simplified arrangement assuming only one of the springs 13 and an actuator 11 of the relay assembly of FIGS. 1 and 2, the identical steps may be performed to simultaneously adjust the gaps between actuator beams 11 and 12 and contacts 35 of that relay assembly. The contact adjusting method is manifestly equally applicable to the make relay modification described in the foregoing. In the make mode of operation it has been found that the optimum gap width to ensure reliable contact operation is somewhat greater than for the break mode. Accordingly, a higher adjust voltage Va is employed to achieve a slightly greater flexure of the beams 11 and 12.

In the foregoing description, the contact adjusting method of this invention was assumed as being largely manually practiced. In actual practice, however, it is contemplated that the various steps of the method will be performed at high speed under machine control. Thus, for example, the determination of the adjust voltage Va magnitude, the degree of applied heat and the detection of the solder layer melt, the point of system equilibrium, etc., all may advantageously be performed under microprocessor control.

The contact adjusting method according to this invention was described as practiced in connection with one specific illustrative piezoelectric relay arrangement. It is to be understood that the method will be equally applicable to other relay arrangements devisable by one skilled in the art without departing from the spirit and scope of the invention as limited only by the accompanying claims.

We claim:

1. In the fabrication of a piezoelectric relay comprising a substrate, a bracket supporting a fixed contact mounted on said substrate by a solder layer, a flexible spring mounted on said substrate having a moveable contact affixed at an end thereof normally bearing on said fixed contact by the force of said spring, and an actuator beam mounted on said substrate adapted to engage said spring for raising said moveable contact from said fixed contact responsive to the application of an operate voltage thereto; a method for adjusting the operating gap between said spring and said actuator beam comprising the steps of adjusting the thickness of said solder layer so that an initial gap is presented between said actuator beam and said spring, applying an adjust voltage to said beam of a magnitude sufficient to cause a free deflection toward said spring exerting a nominal force substantially equal to said spring force, applying heat to said solder layer to its melting point to permit said spring to urge said bracket towards said substrate and to permit said spring to contact said beam, removing said heat when the combined reactive forces of said fixed contact and said beam equal said spring force, and removing said adjust voltage to leave a final gap between said spring and said beam.

2. In the fabrication of a piezoelectric relay comprising a substrate, a flexible spring mounted on said substrate having a moveable contact affixed at an end thereof, an actuator beam mounted on said substrate adapted to control said spring responsive to the application of an operate voltage thereto, and a bracket supporting a fixed contact having said moveable contact urged thereon by the force of said spring, said bracket being mounted on said substrate by a solder layer of a thickness to present an initial gap between said actuator beam and said spring; a method for adjusting the operating gap between said actuator beam and said spring comprising the steps of applying an adjust voltage to said beam of a magnitude sufficient to cause a free deflection toward said spring exerting a nominal force substantially equal to said force of said spring, applying heat to said solder layer to its melting point to permit said spring to urge said bracket towards said substrate and to permit said spring to contact said beam, and removing said heat when the combined reactive forces of said fixed contact and said beam equal said force of said spring so that a final gap is presented between said spring and said beam when said beam is restored.

3. A method for adjusting the operating gap between an actuator beam and a contact spring of a piezoelectric relay, said contact spring having a moveable contact bearing on a fixed contact by the force of said spring, comprising the steps of mounting said fixed contact on a substrate of said relay by means of a bracket and a solder layer of a thickness sufficient to present an initial gap between said beam and said spring, applying an adjust voltage to said beam of a polarity and magnitude sufficient to cause a free deflection of said beam toward said spring exerting a nominal force substantially equal to said force of said spring, applying heat to said solder layer to its melting point to permit said spring to urge said bracket towards said substrate and to permit said spring to apply a force against said beam, and removing said heat when the reactive forces of said beam and said fixed contact and said force of said spring reach equilibrium so that a final gap is presented between said beam and said spring as said beam is restored when said adjust voltage is removed.

* * * * *